United States Patent [19]

Kuhlen et al.

[11] 4,403,925

[45] Sep. 13, 1983

[54] DIAPHRAGM FUEL PUMP AND ASSOCIATED METHOD

[75] Inventors: Ernst Kuhlen, Willich; Manfred Winkels, Dusseldorf, both of Fed. Rep. of Germany

[73] Assignee: Pierburg GmbH & Co. KG, Neuss, Fed. Rep. of Germany

[21] Appl. No.: 289,752

[22] Filed: Aug. 3, 1981

[30] Foreign Application Priority Data

Sep. 12, 1980 [DE] Fed. Rep. of Germany ..... 3034448

[51] Int. Cl.[3] ..... F04B 43/06

[52] U.S. Cl. ..... 417/395; 91/347

[58] Field of Search ..... 417/395; 91/347

[56] References Cited

U.S. PATENT DOCUMENTS 2,340,454 1/1944 Conde ..... 91/347 X 2,358,037 9/1944 Sunderland ..... 91/347 X 2,631,573 3/1953 Levitt et al. ..... 91/347 X

FOREIGN PATENT DOCUMENTS 219732 8/1957 Australia ..... 417/395

3175 of 1908 United Kingdom ..... 91/347

*Primary Examiner*—Leonard E. Smith

*Attorney, Agent, or Firm*—Posnack, Roberts, Cohen & Spiecens

[57] ABSTRACT

A pneumatically operated diaphragm fuel pump comprising a ram actuated by a diaphragm and arranged in a drive chamber and a reversible lever subjected to the action of a tension spring for actuating suction and air-inlet valves. The lever is locked with respect to the ram for a given range of stroke of the ram and switching takes place only at the dead center positions of the diaphragm.

12 Claims, 4 Drawing Figures

DIAPHRAGM FUEL PUMP AND ASSOCIATED METHOD

FIELD OF THE INVENTION

The present invention relates to a diaphragm pump, and particularly to a diaphragm pump adapted for delivery of fuel. Such a pump has a working chamber and a second chamber which is separated from the working chamber by the diaphragm. A compression spring acts on the diaphragm. At the end of one stroke of the diaphragm, the second chamber is supplied with atmospheric air by means of a rod via a valve and at the end of the other stroke, the second chamber is connected to a vacuum source via a second valve. A lever which actuates the valves is switched as a result of displacement of the plane of action of a tension spring.

PRIOR ART

A fuel pump of the above type is shown in U.S. Pat. No. 2,221,071. This diaphragm pump, however, has the disadvantage that the switch points occur only approximately at the end of each stroke and not precisely at a dead center position. In this diaphragm pump, the suction and air-inlet valves are switched simultaneously in opposite direction since the valve closure members are arranged on a common lever which is functionally connected to the lever which is actuated by the tension spring. The exact switch point of the valve actuation in this case is dependent on the spring force, so that, with due consideration of the tolerances of the springs and of the mass produced lever system, the switch point can not be precisely fixed, so that the pumps will have a correspondingly wide range of strokes resulting in different pump outputs. Furthermore, due to the provision of the two valve members on one lever, valve overlaps take place with this pump during the switching phases so that a correspondingly increased consumption of the operating fluid results.

SUMMARY OF THE INVENTION

An object of the invention is to provide a diaphragm pump in which the switching of the suction valve and of the air-inlet valve is associated precisely with the corresponding dead-center position of the diaphragm at its ends of stroke in order to be able to utilize the maximum stroke to increase the efficiency and limit the consumption of the working fluid to that which is absolutely necessary.

This and other objects of the invention are achieved by a pump construction of the aforementioned type in which the lever, which is under the pulling action of its operating, tension spring, consists of three arms and is pivotably mounted at its center to the pump housing in the second chamber, the free ends of two lever arms lying in the same plane alternately actuating the suction valve and air-intake valve respectively and the third arm being arranged perpendicular to the other two arms and being provided at its free end with a segment which faces a ram which is coupled to the diaphragm, said segment cooperating with an oppositely directed segment on the ram, the plane of action of the tension spring which is attached at one end to the housing and at the other end to a free end of the lever being displaced as a function of the position of the ram by two projections which act on the center of the spring and are arranged in spaced relation on the ram.

By this arrangement, the result is obtained, in simple fashion, that the member which actuates the valves is brought into a position of readiness for switching, corresponding to the specific stroke, but can effect the switching process only after it has been released as a function of the stroke. In this way, the switching is prevented from taking place before the end of the stroke, and valve overlaps are avoided.

DETAILED DESCRIPTION

Figure 1:
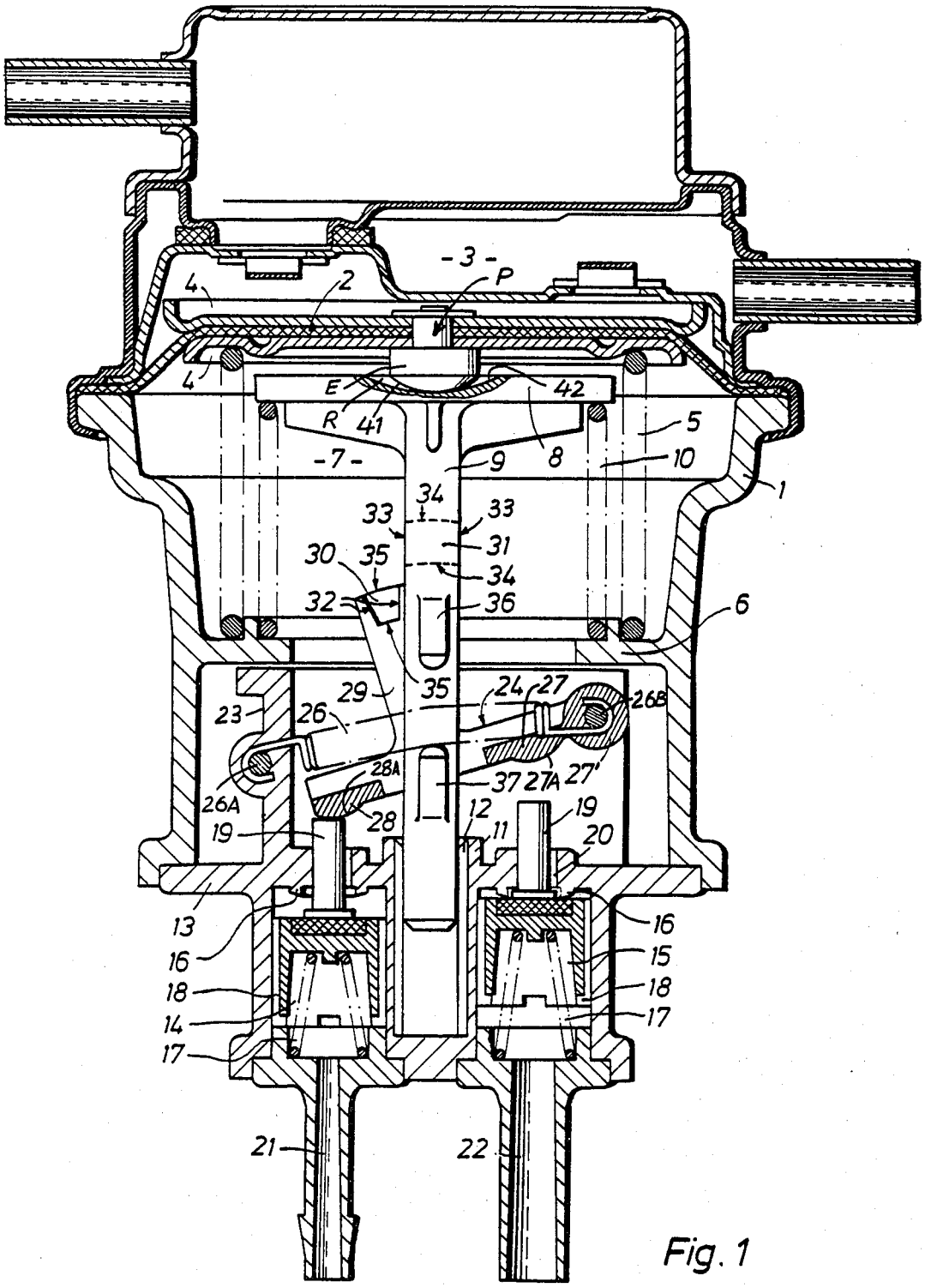
FIG. 1 is a sectional view through a diaphragm pump according to the invention.

In the drawing there is seen a housing 1 of a diaphragm fuel pump in which the outer peripheral edge of a diaphragm 2 is clamped within the housing 1. Above the diaphragm 2 is defined a conventional pump working chamber 3 of the pump. The diaphragm is provided with conventional diaphragm disks 4 at its upper and lower surfaces, the disk at the upper surface serving as a stop by bearing against the housing and the disk at the lower surface being acted on by a working spring 5 which is seated at its opposite end against a shoulder 6 of the housing in a pump drive chamber 7 defined beneath the diaphragm 2. The diaphragm 2 is in operative contact with a head 8 of cylindrical shape of a ram 9 under the action of a spring 10 which bears against head 8 and is also seated on the shoulder 6. The engagement of the diaphragm with the head 8 is effected by a central connector P which clamps the disks 4 to the diaphragm 2 and is provided with an enlarged end E penetrating into a recess R in the head 8 and bearing thereagainst via a curved surface 41 on end E and a curved surface 42 of the recess R. The ram 9 is guided at its lower end in a bore 11 at the bottom of the housing. The housing is provided with slits 12 which open into bore 11 for venting the bore such that no air cushions can be formed which would interfere with reciprocation of the ram. The drive chamber 7 is closed at its lower end by a bottom wall 13 whereat are located an exhaust valve 14 and an air inlet valve 15, the valves 14 and 15 having valve seats 16 in the wall 13. The valves are of identical construction. Each valve includes a displaceable valve body disposed in a respective chamber and urged to a closed position by a spring 17. The valve body is provided with slots 18 at its lower end to provide fluid communication between the interior and exterior of the valve body. The bodies of valves 14 and 15 are each provided with a rod 19 which extends through the bottom wall 13 into the working chamber 7. Each rod 19 is guided in the bottom wall 13 in a bore having grooves 20 such that passage of fluid is possible when the valve is open. Instead of grooves 20 in the bores receiving the rod 19, the grooves could be provided in the rods themselves. The valve 14 is coupled by a vacuum connection 21 to a vacuum source such as a separate vacuum pump (not shown). Valve 15 is coupled by a connection 22 to the atmosphere, for example, via an air filter (not shown).

Figure 2:
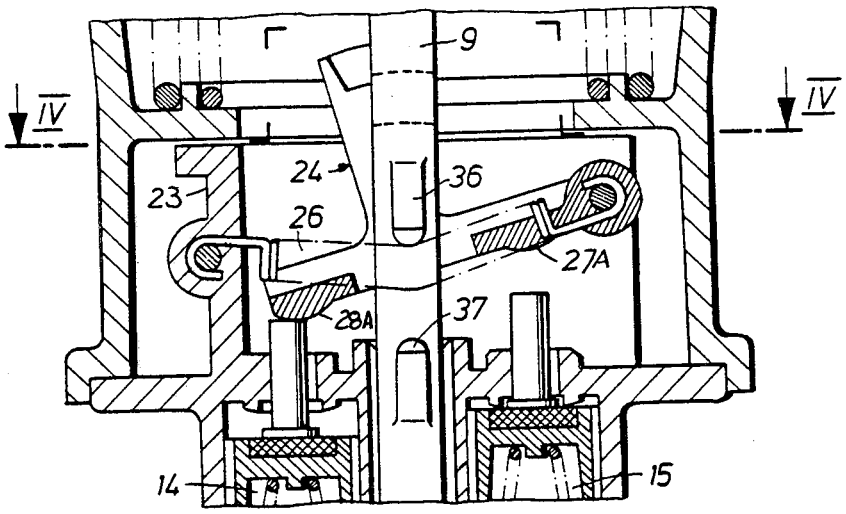
FIG. 2 is a sectional view of a portion of the pump just before lower dead center position.
Figure 3:
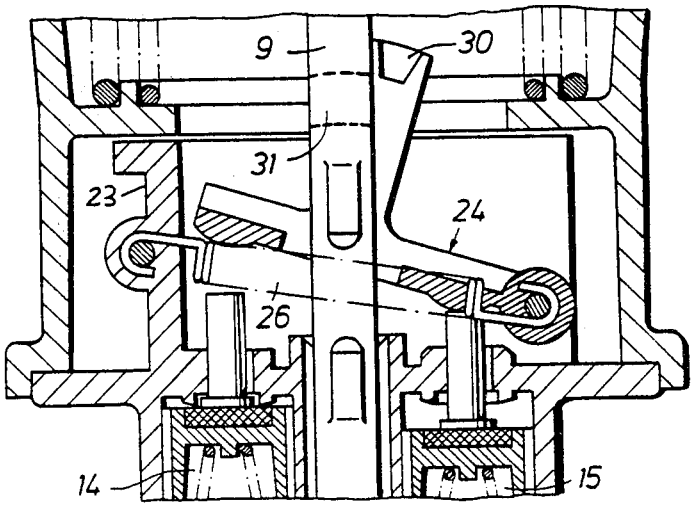
FIG. 3 is a sectional view of the portion of the pump in the lower dead center position.
Figure 4:
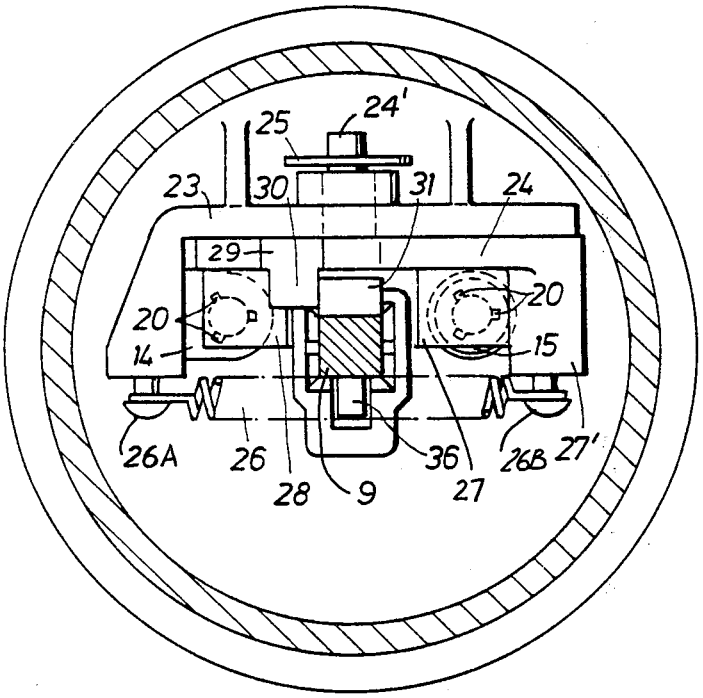
FIG. 4 is a sectional view taken along line IV—IV in FIG. 2.

Integral with the wall 13 is an upstanding portion 23 of L-shaped profile as seen in FIG. 4. A three-armed lever 24 carries a pin 24' which is fitted in a bore in portion 23 such that the lever 24 is pivotably movable on portion 23 within the drive chamber 7. A retaining disk 25 is fitted on pin 24' to hold the pin and thereby the lever 24 on the portion 23. A tension spring 26 is connected at one end via pin 26A to housing portion 23 and at its other end via pin 26B to the free end portion 27' of an arm 27 of the lever 24. The lever 24 has an arm 28 projecting laterally at the end opposite arm 27 and arms 27 and 28 are disposed in a common plane and include respective rounded actuating surfaces 27A, 28A which are also disposed in a common plane. The actuating surface 28A is intended to cooperate with rod 19 of suction valve 14 and actuating surface 27A is intended to cooperate with rod 19 of air-inlet valve 15. The mounting of the lever 24 on housing portion 23 is such that the actuating surfaces of lever arms 27 and 28 will, under the action of the tension spring 26, actuate either the rod 19 of the suction valve 14 or the rod 19 of the air-inlet valve 15 upon pivotal movement of the lever 24 to open the corresponding valve. Extending perpendicular to the plane of the two lever arms 27 and 28 is a third lever arm 29 whose upper free end carries an integral segment 30 which faces another segment 31 on the ram 9. Each of the segments has two lateral guide surfaces 32 and 33 respectively which cooperate with each other. Furthermore, each of the segments 30 and 31 has two slide surfaces 34 and 35 of arcuate shape, which permit the pivotal movement of the lever 24 under the action of the tension spring 26 which the two segments 30 and 31 come out of registry and lose contact along the guide surfaces 32 and 33 by the displacement of the ram 9. The segments 30 and 31 are shown in contacting position in FIG. 4. On the ram 9, in axial spaced relation, are two projections 36 and 37 which, as can be seen in FIGS. 1–3, engage the tension spring 26 which is tensioned transversely of the projections 36,37 to urge the lever 24 to undergo pivotal movement.

The pump operates in the following manner.

In the position shown in FIG. 1 the diaphragm 2 is in the upper dead center position, i.e. the suction valve 14 is opened by contact of the abutment surface 28A of lever 28 with the rod 19 and the diaphragm chamber 7 is under vacuum.

The diaphragm 2 now moves downwardly, under the action of the vacuum, against the force of spring 5 and it carries the ram 9 via the head 8 along with it in this movement against the force of the spring 10. The lateral guide surfaces 32,33 of the segments 30, 31 begin to overlap at a given lowered position of the ram. The projection 36 on the ram 9 comes to bear, during this downward movement, against the spring 26 to bend the spring as shown in FIG. 2, thereby to change the plane of action of the spring 26. Due to the change in the plane of action of the spring, the lever 24 is urged to pivotably move to the position shown in FIG. 3. However, this pivotal movement is blocked as long as the two guide surfaces 32, 33 are in contact with each other. When the segment 31 reaches the lower end of the lateral guide surface 32 on the segment 30 as a result of the continued downward stroke of the ram 9, the arcuate slide surfaces 34,35 on the segments come into registry and permit the lever 24 to pivot to the position shown in FIG. 3 under the action of the tension spring 26 since the blocking contact between the segments 30,31 at the guide surfaces 32,33 is then terminated. No canting or jamming of the ram or lever can occur in view of the arcuate shape of the slide surfaces. Furthermore, the guide surfaces 32 on segment 30 are inclined downwardly towards one another so that the guide surfaces 32 and the guide surfaces 33 will be in planar contact with the arm 29 in inclined blocked position and thereby will not inhibit axial travel of ram 9. FIG. 3 shows the lower dead center position in which the suction valve 14 is closed and the air-inlet valve 15 opened.

Upon supply of atmospheric air to the pump drive chamber 7 as valve 15 is opened, the diaphragm 2 will undergo the operating stroke, i.e. the feed stroke of the fuel pump, under the action of the springs 5 and 10. The ram 9 thus moves upwardly under the action of the spring 10 and after a given displacement, the projection 37 comes to bear against the tension spring 26 and cause bending thereof, resulting in a corresponding displacement in the plane of action of the spring so that the lever arm 24 is urged to return to the position shown in FIG. 1. However, the pivotal movement of lever arm 24 is prevented from occuring, in a manner analogous to that already described in connection with the reverse course of motion, since the segments 30,31 are in blocking contact with each other via their lateral guide surfaces 32, 33. The pivotal movement of lever 24 is prevented until such contact is terminated whereafter lever arm 24 will be released and will pivot while segment 30 will slide via its arcuate surface 35 along arcuate surface 34 on segment 31. As a result of the position of the segment 31 on the ram 9 relative to the segment 30 arranged on the lever 24 it is therefore possible to determine precisely the switch point of the valves as a function of the stroke actually carried out by the diaphragm and thereby establish the switch points of the valves exactly at the end of stroke positions of the diaphragm. In the course of movement of the diaphragm 2 between its end of stroke position, fuel is drawn into chamber 3 during downward travel of diaphragm 2 and is discharged from chamber 3 during upward travel of diaphragm 2 as in conventional pumps. Because the switching of the valves takes place precisely at the end of stroke positions of the diaphragm, the pump output will be precisely determined and is substantially independent of the strength of the springs and tolerances of manufacture. The segments control the precise position at which the lever will operate the valves and, accordingly, a series of mass produced pumps will have substantially identical strokes and pump outputs. Moreover, since one valve is opened when the other is closed, there will be no valve overlap.

In essence, the invention is essentially characterized by the operation wherein the valves are successively opened and closed in alternation in accordance with the movement of the ram and under the control of the segments on the ram and lever to effect switching of the valves precisely when the diaphragm has reached its end of stroke positions. Moreover, because the lever is subject to the biasing force of the tension spring while the segments are still in abutment with one another, when the abutments come out of registry to permit the lever to undergo pivotal movement, this will be instantaneously effected such that opening of one valve and closure of the other will be effected substantially concurrently.

It will be evident that the principle which has been described can also be employed in diaphragm pumps which are operated with fluid under pressure rather than vacuum at valve 14. In such case the direction of action of the force of the spring 5 is merely reversed.

Although the invention has been described in conjunction with a specific embodiment thereof it will become apparent to those skilled in the art that numerous modifications and variations can be made within the scope and spirit of the invention as defined by the attached claims.

What is claimed is:

1. A diaphragm fuel pump comprising a housing, a diaphragm in said housing forming a pump chamber and a drive chamber therein, said diaphragm being movable between first and second end of stroke positions to draw fuel into said pump chamber and discharge the fuel therefrom, resilient means acting on said diaphragm for urging the diaphragm to one of said end positions, a ram coupled to said diaphragm to undergo movement in opposite directions in accordance with the movement of said diaphragm between said end of stroke positions, first valve means for controlling supply of working fluid to said drive chamber, the supply of working fluid to said drive chamber applying force to said diaphragm to overcome the action of said resilient means and produce displacement of the diaphragm towards the other of said end of stroke positions, second valve means for controlling communication of said drive chamber with atmospheric air, the connection of said working chamber to atmospheric air causing the diaphragm to return to said one end of stroke position under the action of said resilient means, lever means pivotably mounted on said housing for selectively opening and closing said first and second valve means, control means on said lever means and said ram for blocking opening and closing of the first and second valve means until the diaphragm is at said end of stroke positions, said control means including a first segment on said lever means and a second segment on said ram, said segments being respectively positioned on the ram and lever means to face one another to block pivotal movement of the lever means, and actuator means on said ram for urging said lever means to undergo pivotal movement in accordance with the movement of the ram under the action of the diaphragm and resilient means, the positions of said segments on said ram and lever means being such to release the lever means and permit pivotal movement thereof when the diaphragm is at its end of stroke positions, said lever means comprising two lever arms in a common plane, one for actuating the first valve means, the other for actuating the second valve means, and a third lever arm carrying said first segment.

2. A diaphragm fuel pump as claimed in claim 1 wherein the segment on the lever means has a surface which rides on a corresponding surface on the segment on the ram when the lever means is released, said surfaces being arcuate in shape to permit smooth pivotal movement of the lever means.

3. A diaphragm fuel pump as claimed in claim 2 comprising a tension spring acting on said lever means, said actuator means comprising first and second spaced actuator members on said ram for acting on said tension spring to urge the lever means to undergo pivotal movement in respectively opposite directions depending on the direction of movement of the ram, said actuator members and segments being relatively positioned on the lever means and ram such that the actuator members act on the tension spring to urge the lever means to undergo pivotal movement before the segments release the lever means.

4. A diaphragm fuel pump as claimed in claim 2 wherein said tension spring is disposed in a plane at right angles to the direction of travel of said ram.

5. A diaphragm fuel pump as claimed in claims 2 or 4 wherein said segments each have two guide surfaces, one for cooperatively engaging a corresponding one of the guide surfaces of the other abutment for blocking pivotal movement of the lever means in one direction, the other for cooperatively engaging the corresponding other of the guide surface of the other segment for blocking pivotal movement of the lever means in the other direction.

6. A diaphragm fuel pump as claimed in claim 5 wherein the guide surfaces of the segment on the lever means are inclined towards one another so that said guide surfaces of the segment on the lever means will engage the guide surfaces on the segment on the ram in planar contact.

7. In a diaphragm pump having a diaphragm secured in a pump housing to define a pump chamber and a drive chamber on opposite sides of the diaphragm, said diaphragm being movable between first and second end of stroke positions, spring means acting on said diaphragm to urge the diaphragm to said first end of stroke position, a first valve for admission of working fluid into said drive chamber to move the diaphragm to said second end of stroke position against the opposition of said spring means, a second valve for controlling communication between said drive chamber and ambient atmosphere, and lever means for actuating the valves, the improvement comprising a movable ram in said drive chamber coupled to said diaphragm and following the movement thereof, said lever means comprising a three armed lever pivotably supported by said housing in said drive chamber and a tension spring disposed in a plane and connected to said lever and housing, two of said arms of said lever having free ends disposed in a common plane and facing said valves to operate the same in alternation as said lever undergoes pivotal movement, the third arm of said lever extending perpendicular to said two arms, a first segment on said third arm facing said ram, a second segment on said ram facing said first segment, and a pair of axially spaced projections on said ram positioned to engage said tension spring in respective opposite directions of movement of the ram and cause the tension spring to urge said lever to undergo pivotal movement in opposite directions in correspondence with the directions of movement of said ram, said segments being located on said ram and lever at respective positions to block pivotal movement of said lever except at said end of stroke positions of said diaphrgm whereat said abutments are out of registry and the lever is free to move pivotably and operate said valves whereby opening and closing of said valves is effected precisely at said end of stroke positions.

8. The improvement as claimed in claim 7 wherein said projections are spaced on said ram in relation to the location of said segments on said lever and ram such that the actuator members act on the tension spring to urge the lever to undergo pivotal movement after the segments are in the blocking position and before they reach the out of registry position.

9. The improvement as claimed in claim 7 wherein each segment has two guide surfaces, each of which engages a respective guide surface of the other segment during movement of the ram when said lever is blocked against pivotal movement.

10. The improvement as claimed in claim 9 wherein said guide surfaces are flat and in planar contact when said lever is blocked against pivotal movement.

11. The improvement as claimed in claim 9 wherein each segment has two slide surfaces, each of which slides on a respective slide surface of the other segment during pivotal movement of said lever when said lever is unblocked.

12. The improvement as claimed in claim 11 wherein said slide surfaces are arcuately curved.

* * * * *